US005079989A

United States Patent [19]

Chipp et al.

[11] Patent Number: 5,079,989

[45] Date of Patent: Jan. 14, 1992

[54] ELECTROHYDRAULIC VALVE SYSTEM WITH A PRESSURE FEEDBACK SIGNAL MODULATED BY A VELOCITY FEEDBACK SIGNAL WHEN THE VELOCITY EXCEEDS A VELOITY LIMIT

[75] Inventors: Ronald E. Chipp, Oak Park; Paul M. Smith, Madison Heights, both of Mich.

[73] Assignee: Vickers, Incorporated, Troy, Mich.

[21] Appl. No.: 577,861

[22] Filed: Sep. 5, 1990

Related U.S. Application Data

[62] Division of Ser. No. 364,869, Jun. 12, 1989, Pat. No. 4,970,885.

[51] Int. Cl.[5] ..... F15B 13/16

[52] U.S. Cl. ..... 91/361; 91/364

[58] Field of Search ..... 91/361, 364, 459; 60/368; 73/714

[56] References Cited

U.S. PATENT DOCUMENTS

| | | | |
|---|---|---|---|
| 3,009,447 | 11/1961 | Lloyd | 91/364 |
| 4,328,449 | 5/1982 | Calligaris | 91/361 |
| 4,336,745 | 6/1982 | Lund | 91/361 |
| 4,437,385 | 3/1984 | Kramer et al. | 91/364 |
| 4,712,470 | 12/1987 | Schmitz | 91/361 |
| 4,744,218 | 5/1988 | Edwards et al. | 91/361 |

*Primary Examiner*—Edward K. Look
*Assistant Examiner*—F. Daniel Lopez
*Attorney, Agent, or Firm*—Barnes, Kisselle, Raisch, Choate, Whittemore & Hulbert

[57] ABSTRACT

An electrohydraulic system for bending tube stock includes a bend head having a mandrel and an actuator coupled to a bending die for engaging the tube stock and bending the stock around the mandrel. A clamp is coupled to a second actuator for gripping the tube stock, and a third actuator mechanism in the form of a boost cylinder is coupled to the clamp for urging the tube stock lengthwise into the bend head. An electrohydraulic valve is responsive to an electronic valve control signal for variably feeding hydraulic fluid to the boost cylinder, and velocity of slip at the clamp is determined. An input pressure command signal is compared with pressure at the boost cylinder to develop a pressure error signal. Slip velocity is compared with a velocity limit command to develop a velocity difference when slip velocity exceeds the velocity limit, and the pressure error signal is modulated and employed as the valve command signal to maintain slip velocity at or below the level of the velocity limit command.

1 Claim, 3 Drawing Sheets

ELECTROHYDRAULIC VALVE SYSTEM WITH A PRESSURE FEEDBACK SIGNAL MODULATED BY A VELOCITY FEEDBACK SIGNAL WHEN THE VELOCITY EXCEEDS A VELOITY LIMIT

This is a divisional of copending application Ser. No. 07/364,869 filed on Jun. 12, 1989 now U.S. Pat. No. 4,970,885.

The present invention is directed to control of electrohydraulic actuator systems, and more particularly to control of a tube stock bending machine to prevent thinning of the tube wall during the bending operation.

BACKGROUND AND OBJECTS OF THE INVENTION

There are numerous applications in the electrohydraulic control field in which it is desired to control motion and/or pressure at an actuator system and load. In a typical machine for bending tube stock, for example, a bending head includes a mandrel and an actuated die for bending tube stock around the mandrel. During the bending operation, the tube stock is clamped or gripped upstream of the bending head, and is urged toward the bending head during the bending operation to prevent thinning of the tube wall. The clamp is allowed to slip lengthwise of the tube stock, but it is desirable to push the stock into the bending head with pressure that is precisely controlled as a function of motion of the bend actuator and die.

In tube bending machines of the described character, pressure applied by a boost actuator to the tube clamp has been measured, and a pressure relief valve has been modulated to obtain a desired profile of pressure versus time. However, it has not heretofore been attempted to control velocity of slip of the clamping mechanism along the tube stock, or to control lengthwise pressure applied to the tube stock as a function of such velocity. Consequently, control systems heretofore proposed have not obtained desired quality control of the bending operation, particularly as applied to thinning of the tube wall during bending.

It is therefore a general object of the present invention to provide an electrohydraulic actuator system that obtains enhanced and precise control of both pressure and motion at the actuator and load. Another object of the present invention is to provide a system of the described character that embodies state-of-the-art electronic control capability, and yet is easy and economical to implement both in new system construction and in retrofit of existing systems.

Another and more specific object of the present invention is to provide an electrohydraulic system for controlling pressure and velocity at an actuator load, such as at the boost cylinder of a tube bending machine, at a precise programmable function A related object of the invention is to provide an electrohydraulic system for bending tube stock that features enhanced control of the boost cylinder for urging the tube stock lengthwise into the bend head to reduce thinning during the bending operation

SUMMARY OF THE INVENTION

An electrohydraulic system for controlling pressure applied to a movable load coupled to a hydraulic actuator, in accordance with a first important aspect of the present invention, includes an electrohydraulic valve responsive to an electronic valve control signal for variably feeding hydraulic fluid under pressure to the actuator. A sensor provides a pressure feedback signal as a function of hydraulic fluid pressure at the actuator, and a second sensor provides a velocity feedback signal as a function of velocity at the load coupled to the actuator A pressure error signal is obtained as a function of a difference between the pressure feedback signal and a pressure command signal received as an input to the control system. The pressure error signal is modulated as a function of the velocity feedback signal to provide the valve control signal to the valve. Specifically, in a preferred embodiment of the invention the velocity feedback signal is compared to a velocity limit command signal input to the system to develop a velocity difference signal when the velocity feedback signal exceeds the limit command signal, and the pressure error signal is modulated as a function of the velocity difference signal to maintain velocity at the actuator and load at a level not greater than that associated with the velocity limit command input.

An electrohydraulic system for bending tube stock, in accordance with a second important aspect and presently preferred implementation of the invention, includes a bend head having a mandrel and an actuator coupled to a bending die for engaging the tube stock and bending the stock around the mandrel. A clamp is coupled to a second actuator for gripping the tube stock, and a third actuator mechanism in the form of a boost cylinder is coupled to the clamp for urging the tube stock lengthwise into the bend head. An electrohydraulic valve is responsive to an electronic valve control signal for variably feeding hydraulic fluid to the boost cylinder, and velocity of slip at the clamp is determined. An input command signal is modulated as function of such slip velocity to develop the valve control signal applied to the valve. In the preferred implementation of the invention, slip velocity is compared with a velocity limit command to develop a velocity difference when slip velocity exceeds the velocity limit, and the input command signal is modulated to maintain slip velocity at or below the level of the velocity limit command.

In the preferred implementation of the invention, the input command takes the form of a pressure command for controlling pressure applied to the tube stock into the bend head. A second feedback control loop, in addition to the velocity feedback control loop previously described, includes a pressure sensor for measuring hydraulic pressure applied to the boost actuator cylinder. Measured pressure is compared with the pressure command, and the valve control signal is developed as a function of a difference between the command and measured pressures. The resulting pressure error is employed to develop the valve control signals and modulated by the velocity control loop only when slip velocity at the tube clamp exceeds the velocity limit command.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
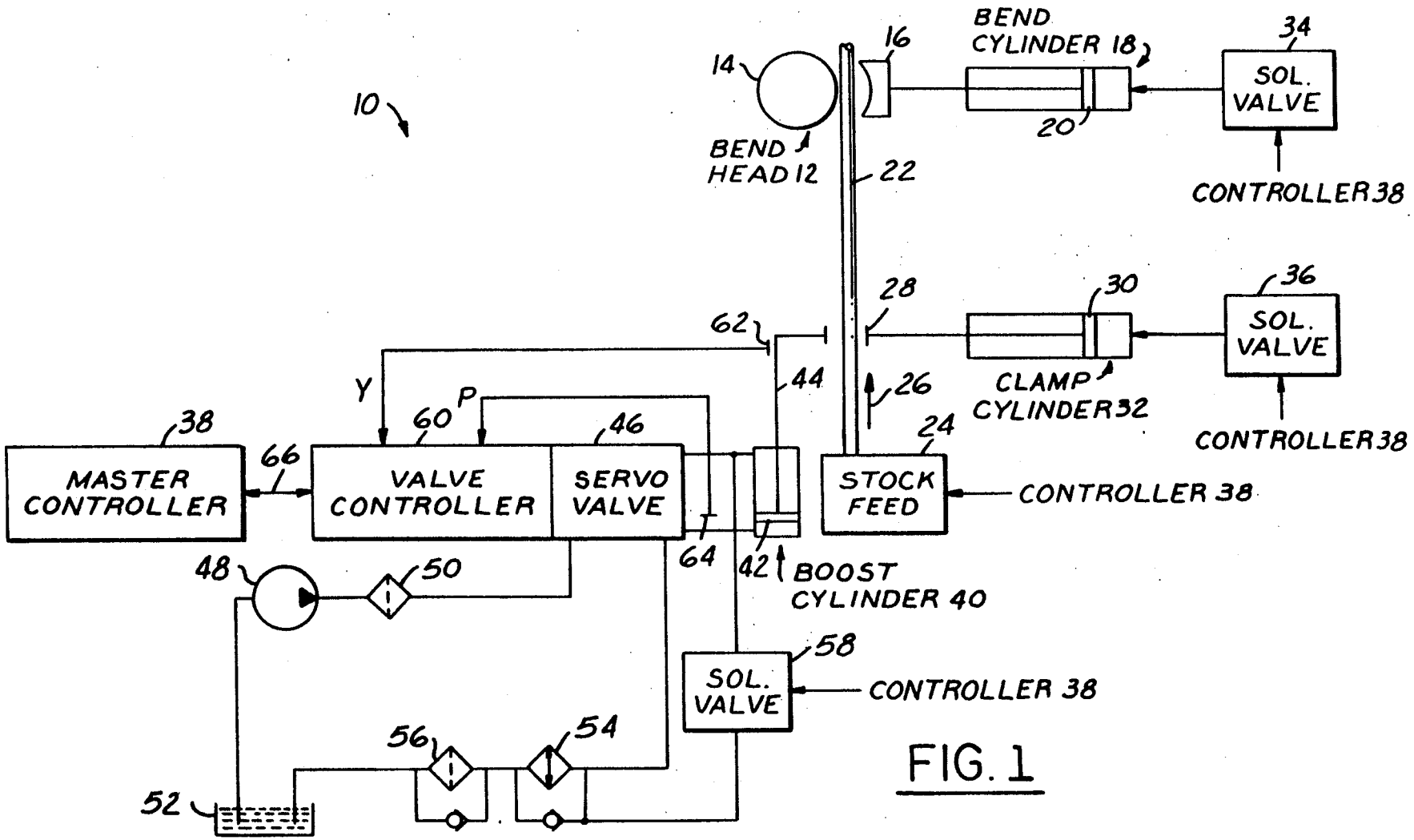
FIG. 1 is a functional block diagram of a tube bending machine and associated control system in accordance with a presently preferred implementation of the invention.

FIG. 1 illustrates a tube stock bending machine 10 in accordance with a presently preferred embodiment of the invention. A bend head 12 includes a mandrel 14 and a die 16 coupled to the piston 20 of a bend actuator or cylinder 18. Tube stock 22 is fed by an intermittent drive 24 in the direction 26 between mandrel 14 and die 16. A clamping mechanism 28 is positioned upstream of bend head 12 with respect to direction 26 of tube stock motion, and is coupled to the piston 30 of a clamp actuator or cylinder 32 for selectively gripping the tube stock. Bend cylinder 18 and clamp cylinder 32 are coupled to associated solenoid valves 34, 36 for selectively feeding hydraulic fluid under pressure to the respective cylinders. Solenoid valves 34, 36 and stock feed mechanism 24 are connected to a master controller 38 for coordinating operation, as will be described hereinafter.

Figure 2:
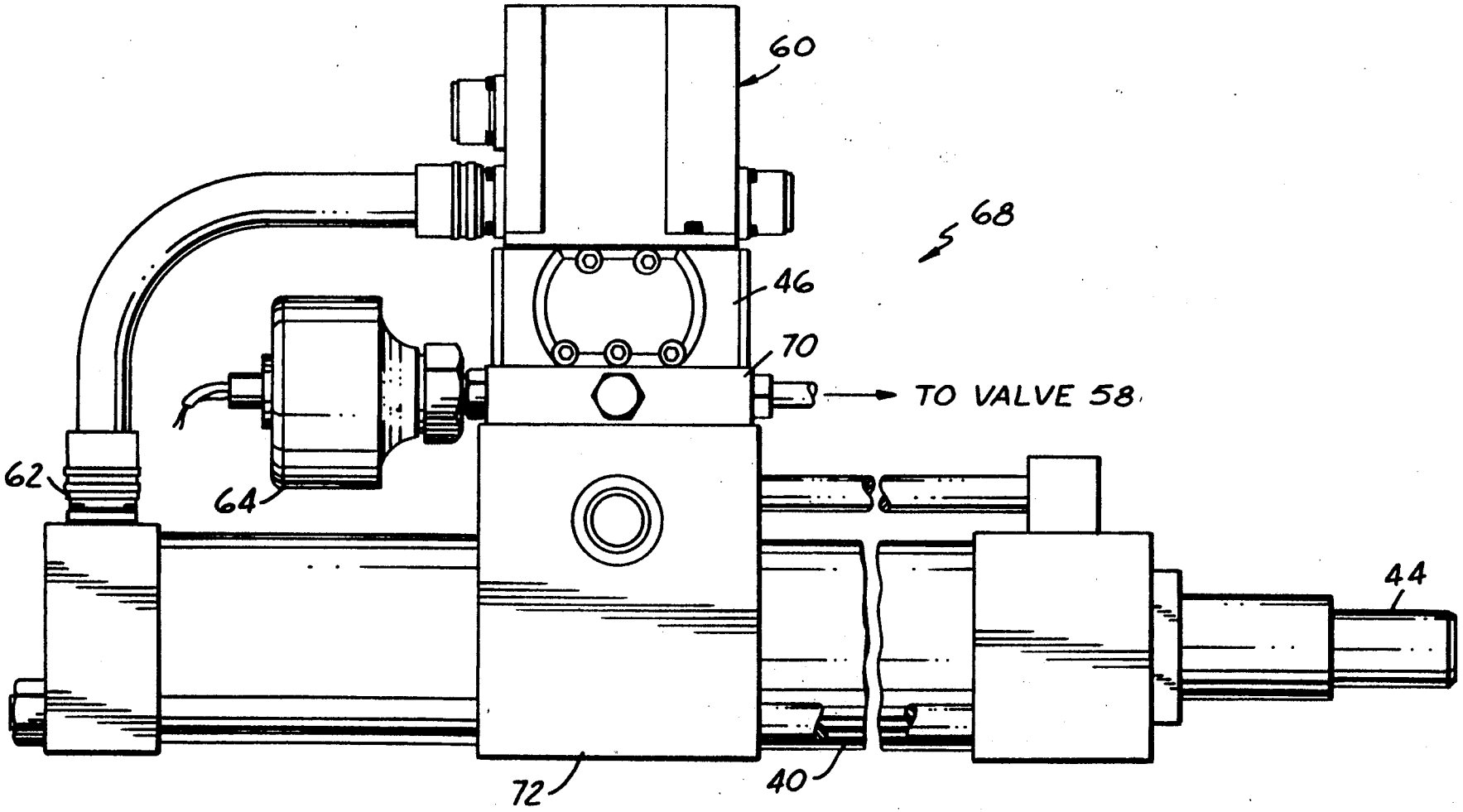
FIG. 2 is a side elevational view of the boost cylinder, valve and valve controller assembly illustrated functionally in FIG. 1.

A boost actuator or cylinder 40 includes a piston 42 having a rod 44 coupled to clamp mechanism 28, and suitable ports for receiving hydraulic fluid under pressure on opposed sides of piston 42. The fluid ports of cylinder 40 are connected to a servo valve 46 that supplies fluid to cylinder 40 from a pump 48 through a filter 50, and returns fluid from cylinder 40 to a sump 52 through a chiller 54 and a filter 56. A solenoid valve 58 is connected between the rod side of cylinder 40 and the return port of servo valve 46, and receives electrical control signals from controller 38 for selectively dumping rod-side cylinder pressure to reservoir 52. A valve controller 60 supplies valve control signals to the torque motor of servo valve 46. An electroacoustic sensor 62 or other suitable sensor is mounted on cylinder 40 and supplies a signal Y to valve controller 60 indicative of position of piston 42 within cylinder 40. A pressure sensor 64 is responsive to drive pressure of hydraulic fluid on the rod-remote side of boost cylinder 40 for supplying to controller 60 a corresponding signal P indicative of fluid pressure Valve controller 60 is connected to master controller 38, preferably by a high-speed bidirectional serial data bus 66, for supplying input command signals to the valve controller and receiving signals from the valve controller indicative of system operation Boost cylinder 40, servo valve 46, valve controller 60, acoustic sensor 62 and pressure sensor 64 preferably take the form of a unitary assembly 68 illustrated in FIG. 2.. Servo valve 46 is mounted by a tap plate 70 to the manifold housing 72 of boost cylinder 40. Tap plate 70 provides for connection of pressure sensor 64 to the fluid passage between servo valve 46 and the rod-remote port of cylinder 40. Valve controller 60 is mounted on servo valve 46, and has multiple connecters for connection to master controller 38 (FIG. 1), pressure sensor 64 and electroacoustic sensor 62. U.S. Pat. No. 4,757,747 discloses controller 60, servo valve 46, actuator 40 and sensor 62 in a unitary assembly that includes microprocessor-based control electronics for providing control signals to the torque motor of valve 46. The control electronics disclosed in such patent also includes facility for actuating electroacoustic sensor 62 and receiving therefrom signals Y indicative of actuator piston position U.S. Pat. No. 4,811,561 discloses an electrohydraulic system that includes actuators with associated servo valves and controllers coupled to a master controller by a high-speed bidirectional serial communication and control bus 66 (FIG. 1). The disclosures of such U.S. Patents, both assigned to the assignee hereof, are incorporated here in by reference.

In general operation, stock feed mechanism 24 is actuated to feed a predetermined length of stock 22 between mandrel 14 and die 16. Stock motion is then arrested, and cylinder 32 is actuated to clamp the stock. Bend cylinder 18 is then actuated to bend stock 22 around mandrel 14. At the same time, boost cylinder 40 is actuated to urge stock 22 in the direction 26 toward bend head 12. Clamp 28 is allowed to slip along stock 22 as long as pressure is maintained. Such pressure into the bend head, when properly controlled, helps reduce thinning of the tube stock wall during the bending operation.

Figure 3:
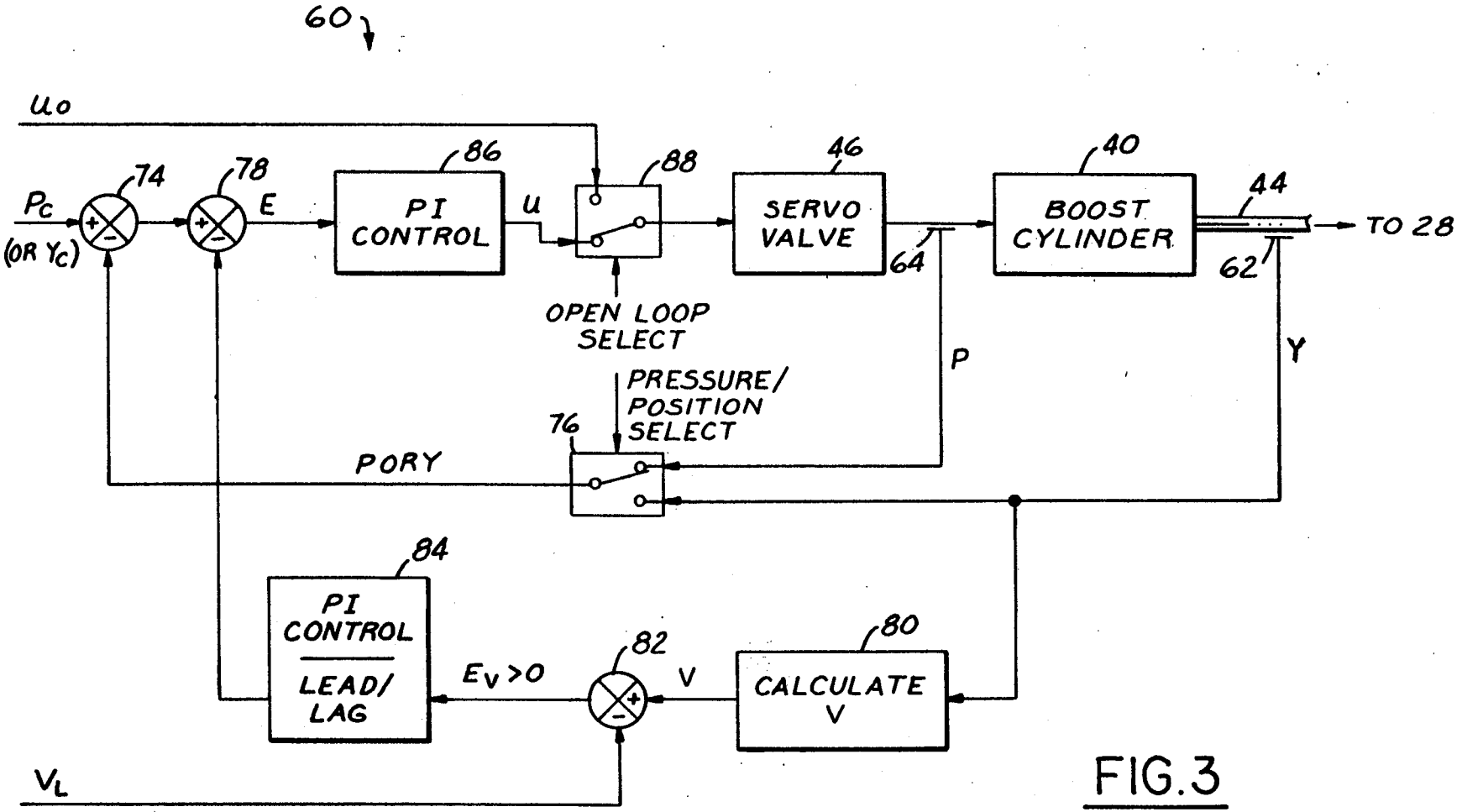
FIG. 3 is a functional block diagram of the valve controller in FIG. 1.

FIG. 3 is a functional block diagram of valve controller 60, coupled to servo valve 46 and boost cylinder 40, configured by suitable programming in a presently preferred mode of controller operation. A comparator 74 receives an input pressure command signal Pc from master controller 38 (FIG. 1) in a pressure control mode of operation, or an input position command signal Yc in a position control mode of operation. Pressure feedback signal P from sensor 64 and position feedback signal Y from sensor 62 are fed to a switch 76 that receives a pressure/position mode selection input (from the master controller), and provides a selected sensor signal output to the second input of comparator 74. The output of comparator 74, indicative of either a pressure error or position error in the selected mode of operation, is fed to one input of a second comparator 78. Slip velocity V at boost cylinder 40 is calculated at 80 based upon cylinder position sensor signal Y, and such velocity is compared at 82 with a velocity limit command signal V1 from master controller 38. When the slip velocity at boost cylinder 40 exceeds the velocity limit command, a velocity error signal Ev is fed to the second input of comparator 78 through a proportional/integral control and lead/lag compensation network 84.

Comparator 78 provides an error signal E to a proportional/integral control network 86, which in turn provides a corresponding valve control signal U to one signal input of an electronic switch 88. The other signal input of switch 88 receives a valve command signal Uo directly from master controller 38 (FIG. 1), and switch 88 is controlled by an open/closed loop mode selection input from the master controller. The output of switch 88 is fed as a pulse width modulated valve control signal to the torque motor of servo valve 46.

In operation, switch 88 is normally configured for closed-loop control (as shown) where command U is fed to servo valve 46, and switch 76 is normally configured for pressure signal feedback as illustrated in FIG. 3. Pressure command Pc is compared with actual pressure P at boost cylinder 40, and a pressure error signal is generated at comparator 74. As long as slip velocity at boost cylinder 44 remains below the level corresponding to velocity limit command V1, the pressure error output of comparator 74 is fed by comparator 78 to control network 86. However, if the slip velocity at boost cylinder 40 exceeds the level of limit command V1, the pressure error output of comparator 74 is correspondingly reduced by velocity error Ev to modulate command U to servo valve 46 and reduce hydraulic fluid flow to a level that maintains the slip velocity at or below the desired limit. It will be appreciated that the profile of pressure command Pc versus time, and velocity limit command V1, are selected in coordination with operation at bend head 12 to obtain bends of optimum quality. Such selection and tailoring are normally done empirically. Facility for selectable position-control and open-loop modes of operation are provide primarily for maintenance and calibration purposes.

We claim:

1. In an electrohydraulic system for controlling pressure applied to a movable load coupled to hydraulic actuator means, including electrohydraulic valve means response to an electronic valve control signal for variably feeding hydraulic fluid under pressure to said actuator means, means for providing a pressure feedback signal as a function of hydraulic fluid pressure at said actuator means, means for receiving a pressure command signal, and means for providing a pressure error signal as a function of a difference between said pressure command signal and said pressure feedback signal, the improvement wherein said system further comprises:

means for providing a velocity feedback signal as a function of velocity of said load, and means for modulating said pressure error signal as a function of said velocity feedback signal comprising means for receiving a velocity limit command signal, means for comparing said velocity feedback signal to said velocity limit command signal to develop a velocity difference signal when said velocity feedback signal exceeds said velocity limit command signal, and means for modulating said pressure error signal as a function of said velocity difference signal to provide said valve control signal to said valve as a function of a difference between said pressure error signal and said velocity difference signal such that pressure applied by said actuator means to said movable load varies a function of velocity at said load only when said velocity feedback signal exceeds said velocity limit command signal.

* * * * *